United States Patent [19]

Banigan

[11] Patent Number: 4,799,894

[45] Date of Patent: Jan. 24, 1989

[54] THREE WIRE GROUNDED, POLARIZED STAGE PLUG AND RECEPTACLE

[76] Inventor: Raymond M. Banigan, 13047 Garris Ave., Granada Hills, Calif. 91344

[21] Appl. No.: 93,990

[22] Filed: Sep. 8, 1987

[51] Int. Cl.[4] ..... H01R 1/00

[52] U.S. Cl. ..... 439/92; 439/105

[58] Field of Search ..... 439/92, 95, 98, 99, 439/105, 106, 108

[56] References Cited

U.S. PATENT DOCUMENTS

| | | | |
|---|---|---|---|
| 3,733,576 | 5/1973 | Cooper | 439/103 |
| 3,739,317 | 6/1973 | Wise | 439/103 |
| 3,786,392 | 1/1974 | McDaniel | 439/103 |

*Primary Examiner*—Eugene R. LaRoche

*Assistant Examiner*—Robert J. Pascal

*Attorney, Agent, or Firm*—John J. Posta, Jr.

[57] ABSTRACT

A stage plug and receptacle for use with high power AC lighting such as that used in the theatrical, stage, and motion picture arts is disclosed which is both polarized and grounded. The stage plugs have a ground terminal added on the top side thereof in a configuration specially adapted to fit in only one orientation into a modified plugging box or receptacle having a corresponding recessed area to receive the ground terminal, thereby simultaneously achieving both grounding and polarization of the equipment. Existing unpolarized, ungrounded stage plugs and plugging boxes formerly used for DC lighting may be inexpensively and quickly converted to the polarized and grounded configuration of the present invention.

18 Claims, 5 Drawing Sheets

FIG. 1 PRIOR ART
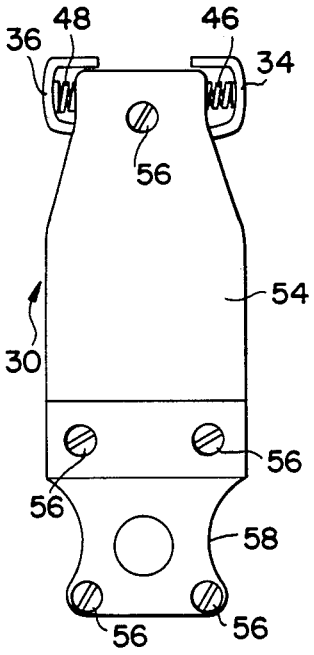
FIG. 3 PRIOR ART
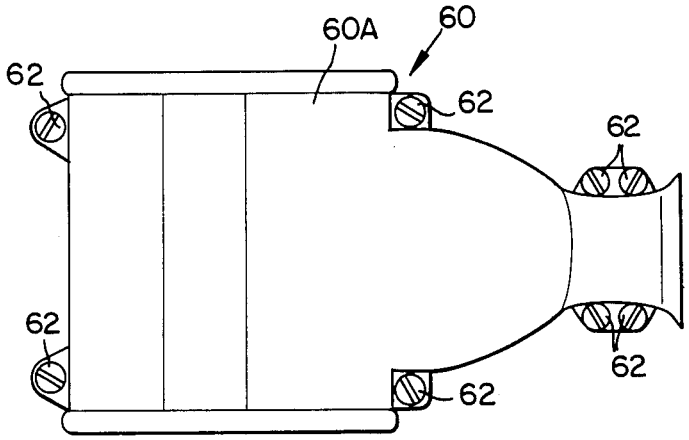
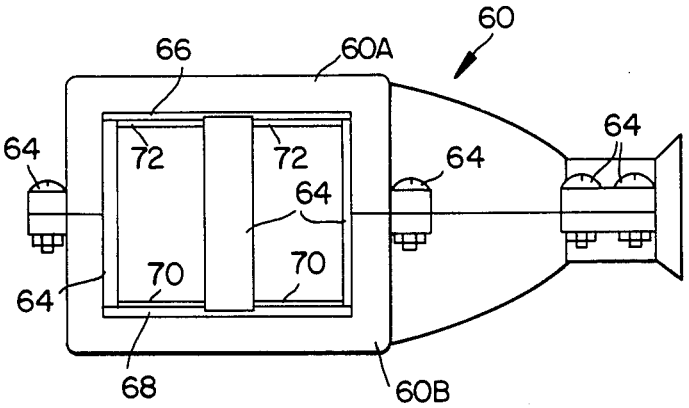
FIG. 4
PRIOR ART
FIG. 2 PRIOR ART
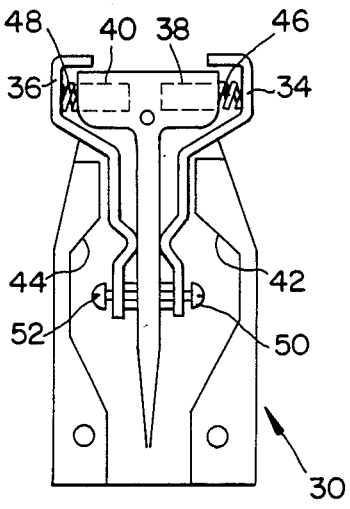
FIG. 5
PRIOR ART
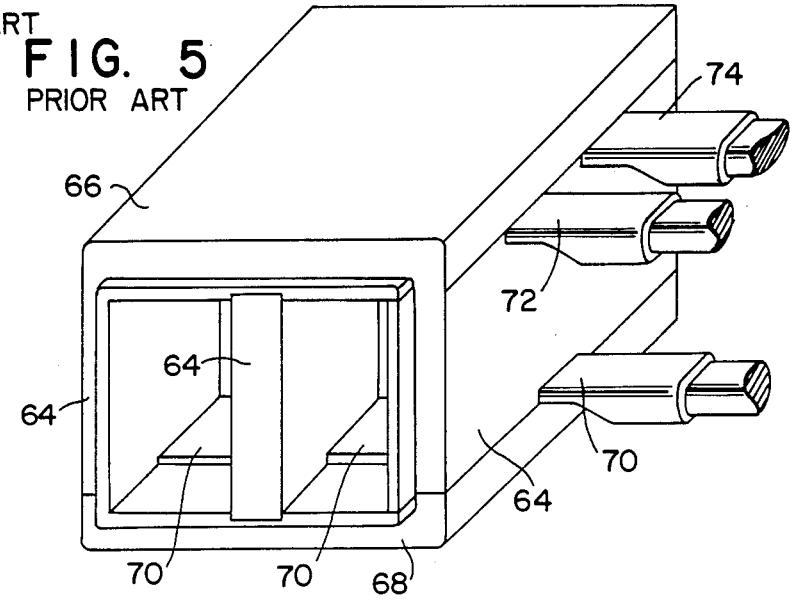

FIG. 13
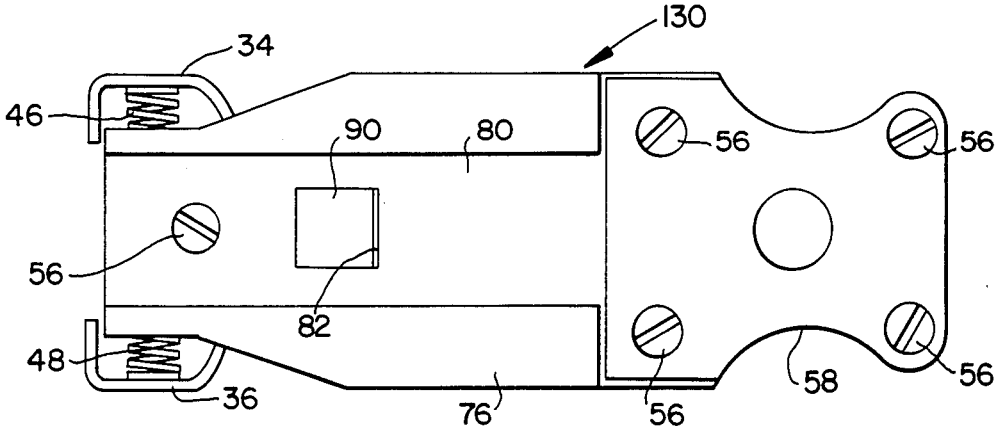
FIG. 14
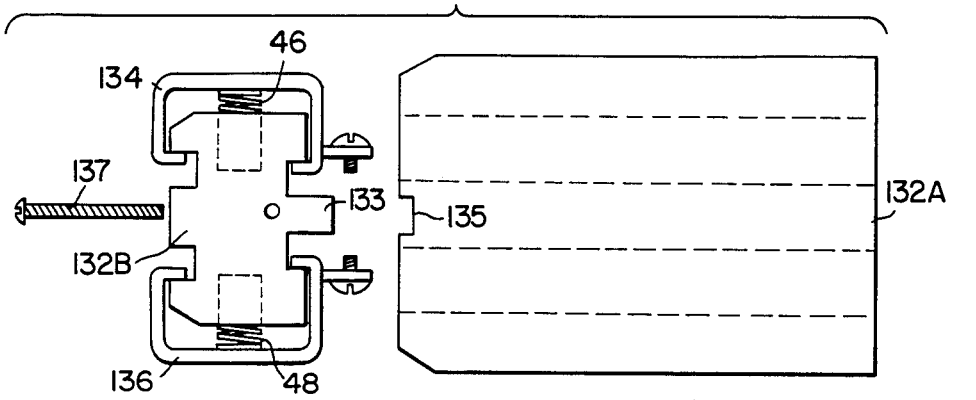
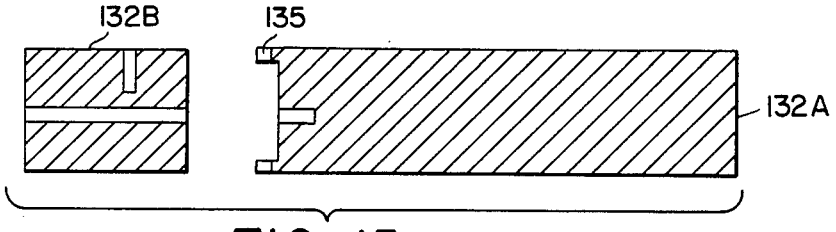
FIG. 15
FIG. 16
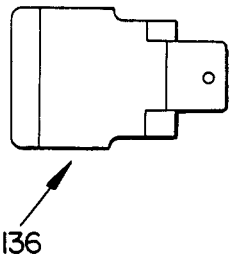

THREE WIRE GROUNDED, POLARIZED STAGE PLUG AND RECEPTACLE

BACKGROUND OF THE INVENTION

FIELD OF THE INVENTION

The present invention relates generally to electrical connectors for removably connecting an electrically-operated device to a box or receptacle connected in turn to a source of electrical power, and more particularly to a grounded and polarized plug and corresponding receptacle for use with theatrical, stage, and motion picture equipment such as high power state-of-the-art lighting equipment.

As alternating current (AC) power systems have largely replaced direct current (DC) power systems, the polarity of plugs and receptacles has become an important safety factor in the mechanical design of the plugs and receptacles. The convention in single phase AC electrical power is to have a "hot" wire and a "neutral" wire. The hot wire is connected to one side of a switch, with the other side of the switch being connected to the electrical device being operated. The neutral wire is connected directly to the electrical device.

When a receptacle is connected to a power source and a plug is used to connect the electrical device and the switch to the receptacle, it will be appreciated that a conventional unpolarized two prong plug may be inserted either way into a conventional unpolarized receptacle. This means that there is a fifty-fifty chance of inserting the plug into the receptacle with the wrong polarity, making the electrical device hot even when the switch is turned off. This is particularly serious with electrical devices which have what should be the neutral lead connected to the chassis or other metal parts of the device. The art has developed two ways of overcoming this problem, one with an independent ground and the other without.

The solution without using an independent ground is to design the plug and receptacle in a way allowing only one way of inserting the plug into a compatible receptacle. This may be accomplished by either aligning the prongs of the plug so as to allow only one way of inserting the plug into a compatible receptacle, or to make the prongs different sizes. The latter solution has found wide acceptance for use with 120V AC electrical power, with one of a pair of parallel prongs being wider than the other. A polarized plug and receptacle will ensure the correct polarity of the electrical appliance, thereby preventing possible electrical shock in electrical devices which have components which may be connected to the wire which is presumed to be the neutral wire. This solution is widely used with domestic lamps and with small appliances.

The solution using a ground pin has found use particularly with large electrical appliances, rather than with small electrical devices or with lights. A third prong is added to the hot prong and the neutral prong, which third prong is an independent ground. The third prong is typically round rather than flat, and is spaced away from and between the two typically parallel hot and neutral prongs. A variety of such ground pins are described in the art, such as for example in U.S. Pat. No. 3,733,576, to Cooper, in U.S. Pat. No. 3,739,317, to Wise, and in U.S. Pat. No. 3,786,392, to McDaniel. The use of a third wire to provide an independent ground will short circuit an inadvertent connection of the hot wire to the electrical device to the ground, thereby preventing the operator of the electrical device from receiving an electrical shock and possibly sustaining a severe physical injury.

The switch to AC from DC and the accompanying switch to the use of plugs and receptacles which are polarized, grounded, or both polarized and grounded has taken place in most parts of the world and in virtually all large electrical devices. One significant exception to this changeover has been in the lighting equipment and accessories which are used in the theatrical, stage, and motion picture industry. Historically, the lighting equipment has been powered by DC electrical power, with DCpowered equipment surviving the switch to AC electrical power by using large rectifiers supplied with DC power from conventional AC electrical power sources.

It will be recognized that the power requirements of the numerous large, high-powered lights used in the theatrical, stage, and motion picture industry are enormous, and that the plugs and receptacles used are likewise large and designed for making the connections between the high power DC supply and the large lighting loads. Stage plugs and receptacles, or "plugging boxes," as they are called, typically can make connections carrying 45 amps at 125 or 250 volts DC. Such receptacles or plugging boxes may be "one hole" (meaning only one stage plug may be inserted) or ganged "two hole," "four hole," or "six hole" portable plugging boxes in which two, four, or six stage plugs, respectively, may be inserted. In addition, fixed "stage pocket" receptacles are fixedly mounted in permanent locations on stages and in theaters for receiving stage plugs. Such stage plugs and their accompanying receptacles or plugging boxes, which are unpolarized and ungrounded, were designed for use with DC power.

Recently the art of lighting has made tremendous technological advances, with current state-of-the-art lighting being designed for use exclusively with AC electrical power. While the stage plugs and plugging boxes are in fact fairly safe when used with DC electrical power, they are absolutely unsafe and hazardous to life and property when used with AC electrical power. Controlling authorities from local communities and their authorities to the nationally known testing laboratories have been unanimous in prohibiting and decrying the use of the stage plugs and plugging boxes with AC electrical power.

This has presented the theatrical, stage, and motion picture industry with a choice between two poor alternatives- either use state-of-the-art lighting and buy polarized and grounded electrical cords and connectors not designed for use in the industry at a tremendous replacement cost, or stick with DC power supplies and the obsolete stage plugs and plugging boxes and use older, technologically obsolete lighting equipment. This is not a very palatable choice, and it makes apparent the need that exists for a way to utilize state-of-the-art AC powered lighting equipment with modified stage plugs and plugging boxes designed for use in the industry.

Accordingly, it is a primary object of the present invention to provide a stage plug and a plugging box for use with high power AC electrical lighting equipment which provides for safe use through both polarization and grounding of the equipment. Such a stage plug and plugging box must be acceptable to the regulating authorities for use with AC electrical equipment. It must also be comparatively simple in construction thereby making it both relatively inexpensive and easy to service, and be strong and durable yet compact and of light weight.

Perhaps most importantly, to provide a further economic incentive the parts of the stage plug and plugging box should be compatible insofar as possible with existing equipment, making it possible to modify existing stage plugs and plugging boxes to provide the ability to upgrade the existing equipment to a polarized, grounded configuration. Finally, a solution to the above-described problems must achieve all of the recited objectives and advantages without incurring any relative disadvantage, either in construction or in use.

SUMMARY OF THE INVENTION

The disadvantages and limitations of the background art discussed above are overcome by the present invention. With this invention, stage plugs and plugging boxes are provided which are both polarized and grounded, making them usable with AC electrical power with both complete safety and efficiency of operation with state-of-the-art AC powered lighting equipment. The construction of the stage plug is quite similar to existing unpolarized and ungrounded stage plugs. The top cover of the stage plug is removed, and a thinner insulating layer is substituted. A ground terminal carried by a ground terminal retaining plate is placed on top of the thinner insulating layer, with a ground terminal contact extending above the surface of the ground terminal retaining plate when the plate and the insulating layer are secured to the stage plug.

The configuration of the ground terminal and the ground terminal retaining plate are narrower than the rest of the stage plug housing, presenting a narrowed width on one side of the stage plug. The inner housing core of the plugging box is replaced with a new inner housing core carrying a ground bar. The new inner housing core is configured to accept the new stage plugs in a single orientation only. When the new stage plugs are inserted into the new plugging box, the ground terminal contact on the ground terminal retaining plate contacts the ground bar in the new inner housing core. Since the new stage plugs may be inserted into the new plugging box in a single orientation only, one of the two contacts on the new stage plugs will always be hot, and the other will always be neutral. It may therefore be appreciated that the new plugging boxes will be both polarized and grounded.

The existing stage plugs may be easily modified to assume the new configuration, with the top cover being replaced with the thinner insulating layer and the ground terminal and the ground terminal retaining plate being added to the stage plug. Likewise, existing plugging boxes may be converted by replacing the existing inner housing core with the new inner housing core carrying the grounding bar. It will be appreciated that all of the original contacts are retained, and that the construction of the present invention is both simple and easy to implement on existing equipment with a minimum of cost and work involved in the changeover.

The stage plugs and the plugging boxes retain their original simplicity of construction, strength, and durability, and are changed only slightly in size and weight. The modification of existing stage plugs and plugging boxes and the construction of new stage plugs and plugging boxes according to the present invention achieves these advantages, plus the most important advantage of enabling the utilization of AC powered state-of-the-art lighting equipment without necessitating the significant expenditures of obtaining all new electrical power transmission equipment which is unsuited for use in the theatrical, stage, and motion picture arts. It will also be appreciated that the present invention achieves all of the aforesaid objectives and advantages without incurring any relative disadvantage, making the present invention a highly desirable improvement in the electrical arts.

DESCRIPTION OF THE DRAWINGS

These and other advantages of the present invention are best understood with reference to the drawings, in which:

FIG. 1 is a plan view from the top of an ungrounded, unpolarized stage plug of the type used for theatrical lighting;

FIG. 2 is a plan view of the stage plug of FIG. 1 with the strain relief and top cover removed to show the construction of the stage plug;

FIG. 3 is a plan view from the top of an ungrounded, unpolarized four hole receptacle or plugging box of the type used for theatrical lighting, which receptacle will accept up to four of the stage plugs shown in FIGS. 1 and 2;

FIG. 4 is a side view of the receptacle of FIG. 3 showing two holes for receiving the stage plugs shown in Figures 1 and 2;

FIG. 5 is a perspective view of the receptacle of Figures 3 and 4 with the outer housing removed;

FIG. 13 is a plan view from the top of the grounded, polarized ground plug shown in FIG. 12;

FIG. 14 is an exploded view from the top of an alternate construction of the load-carrying terminals using a split housing;

FIG. 15 is a cutaway view from the side of the split housing shown in FIG. 14;

FIG. 16 is a plan view of one of the load-carrying terminals of the device shown in FIG. 14 from the spring side thereof;

DETAILED DESCRIPTION OF THE PREFERRED EMBODIMENT

Figure 6:
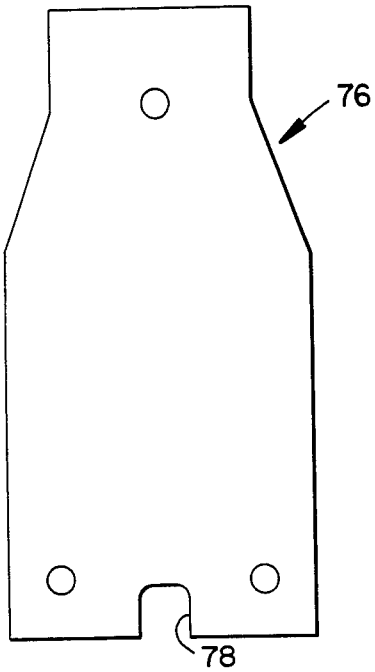
FIG. 6 is a plan view of a top cover for use with either the stage plug shown in FIGS. 1 and 2 or with the stage plug of the present invention.

Before proceeding to a discussion of the preferred embodiment of the present invention, it is advantageous to discuss the existing construction of unpolarized, ungrounded stage plugs and plugging boxes, particularly since the existing apparatus may be easily and conveniently converted to polarized and grounded construction according to the teachings of the present invention. Referring first to FIGS. 1 and 2, a prior art unpolarized, ungrounded stage plug 30 is illustrated. The stage plug 30 has a housing 32 made of electrically nonconductive material for carrying two load carrying contacts 34 and 36 which are exposed on opposite sides of the housing 32 at one end thereof. The two load carrying contacts 34 and 36 are made of electrically conductive material.

The housing 32 has at the end at which the two load carrying contacts 34 and 36 are exposed two cylindrical holes 38 and 40, respectively, which are drilled in corresponding locations on the sides of the housing 32 as it is shown in FIGS. 1 and 2, which cylindrical holes 38 and 40 are drilled only part way into the housing 32, and do not communicate with each other. The ends of the two load carrying contacts 34 and 36 opposite the exposed ends thereof are contained in cavities 42, 44, respectively, in the housing 32. The exposed ends of the load carrying contacts 34 and 36 are biased outwardly by two springs 46, 48, with the spring 46 having one end inserted into the cavity 42 and bearing on the load carrying contact 34, and the spring 48 having one end inserted into the cavity 44 and bearing on the load carrying contact 36. The springs 46 and 48 urge the exposed ends of the the load carrying contacts 34 and 36, respectively, outwardly to assist in making contact with contact plates in a receptacle (not shown in FIGS. 1 or 2).

Figure 12:
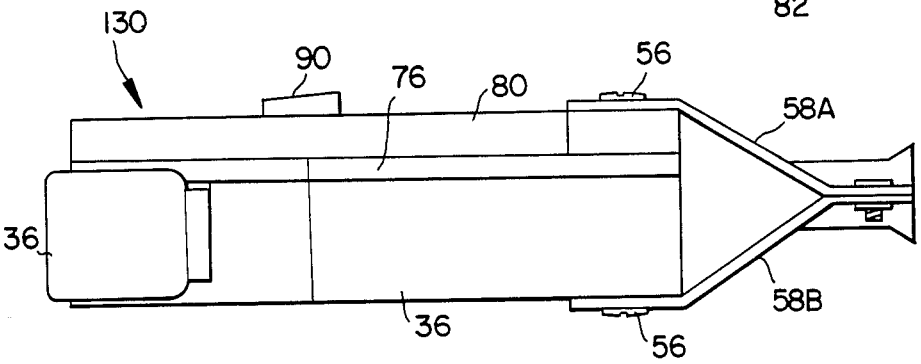
FIG. 12 is a side view of a grounded, polarized ground plug constructed according to the teachings of the present invention.

Wires (not shown) leading to the electrical load (also not shown) may be connected to the ends of the load carrying contacts 34 and 36 contained in the cavities 42 and 44, respectively, with the use of screws or bolts 50, 52, respectively. A top cover 54 made of electrically nonconductive material is located on top of the housing 32 as shown in FIG. 1, and may be secured by screws or bolts and nuts 56. (The general configuration of the top cover 54 is shown in FIG. 6, which is a thin insulating layer which replaces the top cover 54 in the present invention.) Concluding the assembly of the unguarded, unshielded stage plug 30 is a strain relief 58 (consisting of two halves 58A and 58B, as shown in FIG. 12), which is attached to the housing 32 and the top cover 54 at the end opposite the exposed portion of the load carrying contacts 34 and 36 with the screws or bolts and nuts 56.

A prior art unpolarized, ungrounded four hole plugging box 60 for receiving up to four of the the stage plugs 30 is shown in FIGS. 3–5. The plugging box 60 has two outer housing halves 60A and 60B held together by a plurality of bolts and nuts 62, with the two outer housing halves 60A and 60B being generally heavy duty and made of a strong material such as cast iron. At one end of the plugging box 60 is a narrowed end which serves as a strain relief for wires (not shown) exiting the plugging box 60.

Secured between the two outer housing halves 60A and 60B at the other end is an inner housing comprising an inner housing core 64, an inner housing top plate 66 on top of the inner housing core 64, and an inner housing top plate 68 on the bottom of the inner housing core 64. The inner housing core 64, the inner housing top plate 66, and the inner housing bottom plate 68 are all made of an electrically nonconductive material, and together they define four slots in the inner housing for receiving the stage plugs 30, two on each of two opposing sides.

Figure 17:
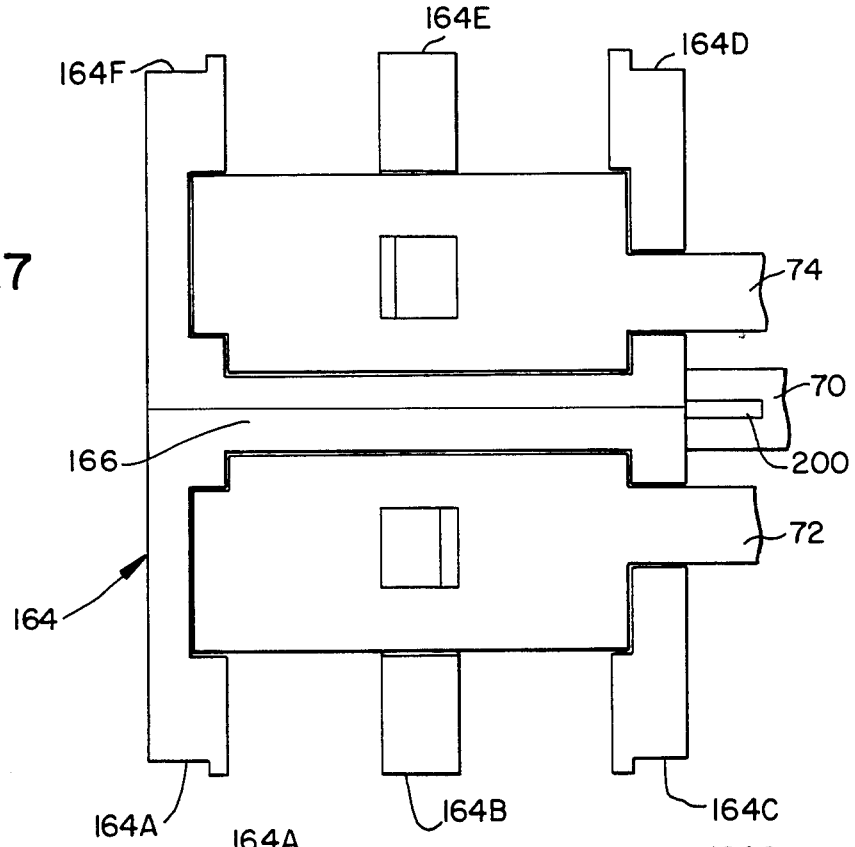
FIG. 17 is a top view of the inner housing core of a grounded, polarized four hole receptacle constructed according to the teachings of the present invention, with the inner housing top and bottom plates removed, showing the installation of the two hot contact plates.
Figure 18:
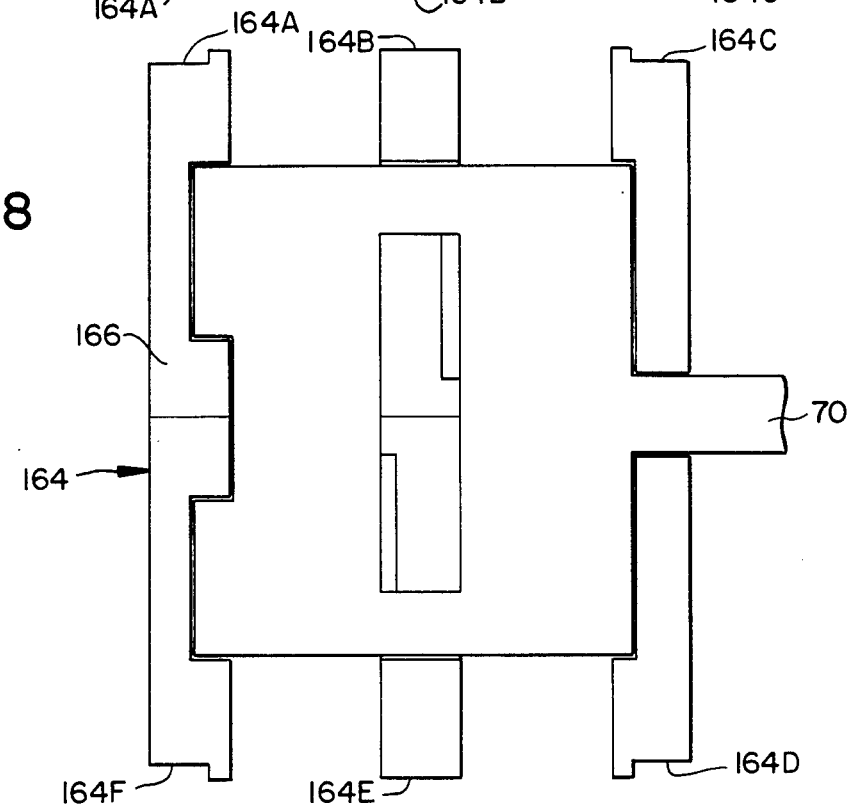
FIG. 18 is a bottom view of the inner housing core shown in FIG. 17, with the inner housing top and bottom plates removed, showing the installation of the neutral contact plate.

Secured between the inner housing core 64 and the inner housing bottom plate 68 is a neutral contact plate 70, which is accessible to the bottom side of each of the four slots in the inner housing, and which extends out of the side of the inner housing as shown to allow connection to a neutral power supply wire. (The neutral contact plate 70 is in the same configuration with respect to the inner housing core 64 as it is shown in FIG. 18 with respect to the inner housing core 164.) Secured between the inner housing core 64 and the inner housing top plate 66 are two non-connected hot contact plates 72 and 74. (The hot contact plates 72 and 74 are in the same configuration with respect to the inner housing core 64 as they are shown in Figure 17 with respect to the inner housing core 164.) The hot contact plate 72 is accessible to the top side of each of the two slots on one side of the inner housing core 64, and the hot contact plate 74 is accessible to the top side of each of the two slots on the other side of the inner housing core 64.

It may therefore be appreciated that if a stage plug 30 is inserted into one of the two slots on the one side of the inner housing, one of the load carrying contacts 34 and 36 will contact the neutral contact plate 70 and the other will contact the hot contact plate 72. Likewise, if a stage plug 30 is inserted into one of the two slots on the other side of the inner housing, one of the load carrying contacts 34 and 36 will contact the neutral contact plate 70 and the other will contact the hot contact plate 74. It will be perceived that either one of the load carrying contacts 34 and 36 on the stage plug 30 may contact the neutral contact plate 70, with the other contacting one of the hot contact plates 72 and 74, making the stage plug 30 and the plugging box 60 of FIGS. 1–5 unpolarized. Similarly, since there is no provision for a ground wire or connection on either the stage plug 30 or the plugging box 60, they are ungrounded.

Moving now to FIG. 6, a thinner insulating layer 76 is shown which has the configuration of and replaces the top cover 54. The insulating layer 76 is made of an electrically nonconductive material, is thinner than the top cover 54 to reduce the size of the improved stage plug, and will replace the top cover 54 on top of the housing 32. (It should be noted that if desired, the top cover 54 may be used instead of the insulating layer 76.) The insulating layer 76 also has a notch 78 removed at the end which will be mounted opposite the end of the housing 32 at which the load carrying contacts 34 and 36 extend. The notch 78 is to allow room for a screw used to connect a grounding wire (not shown) to the improved stage plug, as will become apparent below.

Figure 7:
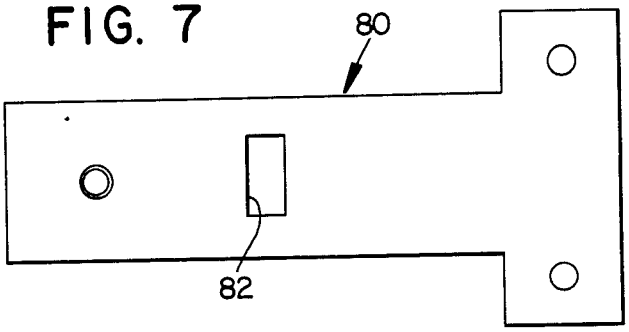
FIG. 7 is a top view of a ground terminal retaining plate for mounting above the top cover of FIG. 6.
Figure 8:
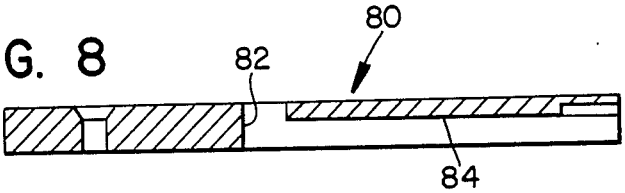
FIG. 8 is a cutaway view of the ground terminal retaining plate of FIG. 7.
Figure 11:
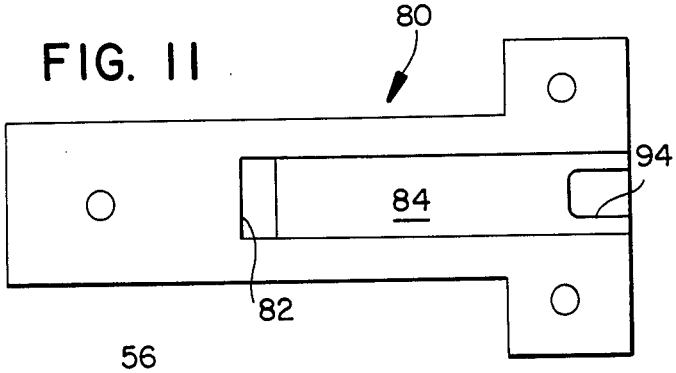
FIG. 11 is a bottom view of the ground terminal retaining plate shown in FIGS. 7 and 8, showing the slot in which the ground terminal is retained.

Moving next to FIGS. 7, 8 and 11, a ground terminal retaining plate 80 is shown which will be mounted on top of the insulating layer 76, which in turn will be mounted on top of the housing 32. The ground terminal retaining plate 80 is T-shaped, with the top of the T going over the end of the housing 32 opposite the end of the housing 32 at which the load carrying contacts 34 and 36 extend, and the leg of the T extending up to the end of the housing 32 at which the load carrying contacts 34 and 36 extend. The leg of the T is also narrower than the width of the housing 32, and the width by which the exposed portions of the load carrying contacts 34 and 36 are spaced apart, to allow polarization of the improved stage plug, as will become apparent below.

Figure 9:
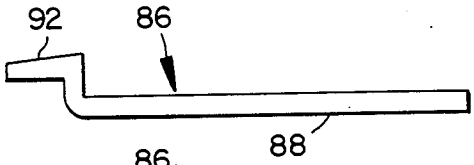
FIG. 9 is a side view of the ground terminal for mounting on the ground terminal plate of FIGS. 7 and 8.
Figure 10:
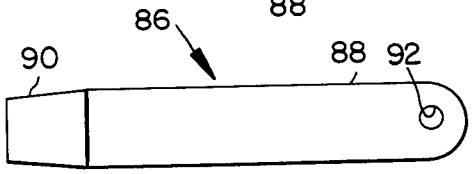
FIG. 10 is a top view of the ground terminal shown in FIG. 9.

The leg of the T of the ground terminal retaining plate 80 also has an aperture 82 therethrough, and a slot 84 on the underside the width of the aperture 82 which slot 84 communicates with and extends from the aperture 82 to the top of the T. Referring now to FIGS. 9 and 10, a ground terminal 86 is shown which is made of electrically conductive material. The ground terminal 86 extends through the aperture 82 in the ground terminal retaining plate 80, with an elongated portion 88 of the ground terminal 86 fitting in the slot 84 on the underside of the ground terminal retaining plate 80.

The ground terminal 86 has on the end extending upward through the aperture 82 a flat ground terminal contact portion 90 which extends over a portion of the surface of the ground terminal retaining plate 80, extending from the aperture 82 toward the bottom of the T. At the end of the elongated portion 88 of the ground terminal 86 is an aperture 92 for receiving a screw (not shown) for connecting a ground wire (also not shown) to the ground terminal 86. A small depression 94 in the slot 84 at the top of the T is designed to receive the head of the screw (not shown) holding the ground wire (also not shown) to the ground terminal 86.

The construction of the polarized, grounded stage plug 130 of the present invention is shown in FIGS. 12 and 13. The ground terminal 86 is placed in position in the ground terminal retaining plate 80, with the elongated portion 88 of the ground terminal 86 in the slot 84 of the ground terminal retaining plate 80 and the ground terminal contact 90 located on the top of the ground terminal retaining plate 80. The ground terminal retaining plate 80 is then placed on top of the insulating layer 76, which is placed on top of the housing 32 (containing the two load carrying contacts 34 and 36 as shown in FIG. 2). Screws or bolts and nuts 56 are used to hold the ground terminal retaining plate 80 and the insulating layer 76 to the housing 32. Completing the assembly are the two halves of the strain relief 58A and 58B, also held to the housing 32 by the screws or bolts and nuts 56.

An alternate embodiment of the housing 32 and the two load carrying contacts 34 and 36 is shown in FIGS. 14-16. A split housing is constructed in two pieces, namely a split housing base piece 132A and a split housing end piece 132B. The split housing end piece 132B looks from the top like a capital I with a tab 133 sticking out of one of the sides of the I in the center. Two load carrying contacts 134 and 136, shown in detail in FIG. 16, are retained on the top and bottom, respectively, of the I which are on the sides of the housing. Springs 46 and 48 are mounted in cylindrical holes 38 and 40 in the top and bottom, respectively, of the I, and bias the two load carrying contacts 134 and 136, respectively, outwardly from the top and bottom, respectively, of the I.

The tab 133 sticking out of the side of the I fits into a notch 135 in the center of the end of the split housing base piece 132A facing the split housing end piece 132B. The top and bottom surfaces of that end of the split housing base piece 132A extend beyond the intermediate portion of that end of the split housing bias piece 132A and fit over a portion of the load carrying terminals 134 and 136, and a screw or bolt 137 is used to fasten the split housing end piece 132B to the split housing base piece 132A. The rest of the assembly to the ground terminal 86, the ground terminal retaining plate 80, and the insulating layer 76 is the same as detailed with reference to FIGS. 12 and 13.

Figure 19:
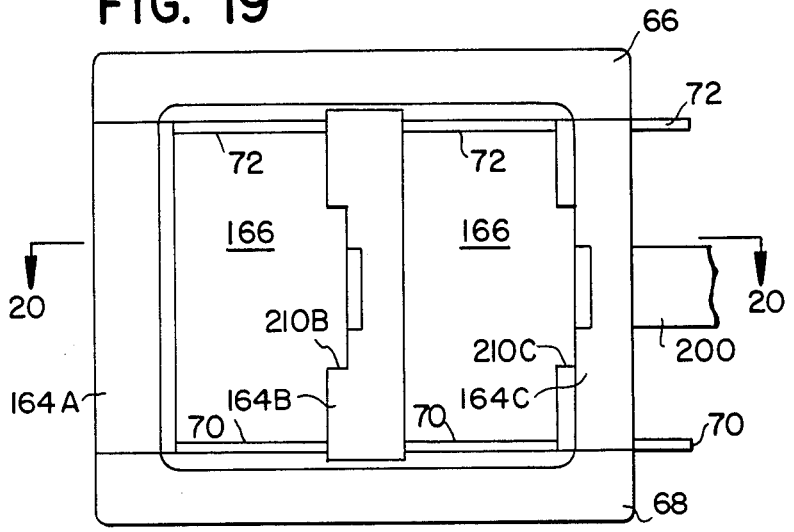
FIG. 19 is a side view of the inner housing core shown in FIGS. 17 and 18, with the inner housing top and bottom plates installed, showing the configuration of the receptacle which cooperates with the configuration of the stage plugs to allow insertion in a single orientation only.
Figure 21:
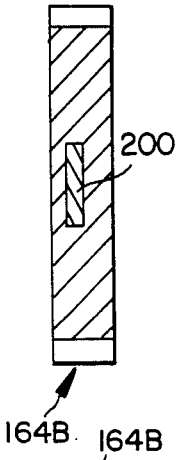
FIG. 21 is a first cutaway view of one of the legs of the inner housing core.
Figure 22:
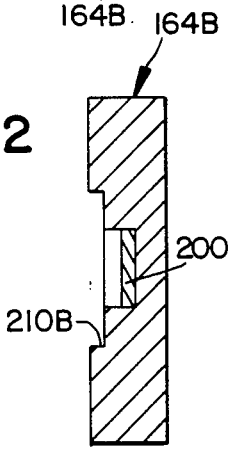
FIG. 22 is a second cutaway view of one of the legs of the inner housing core.
Figure 20:
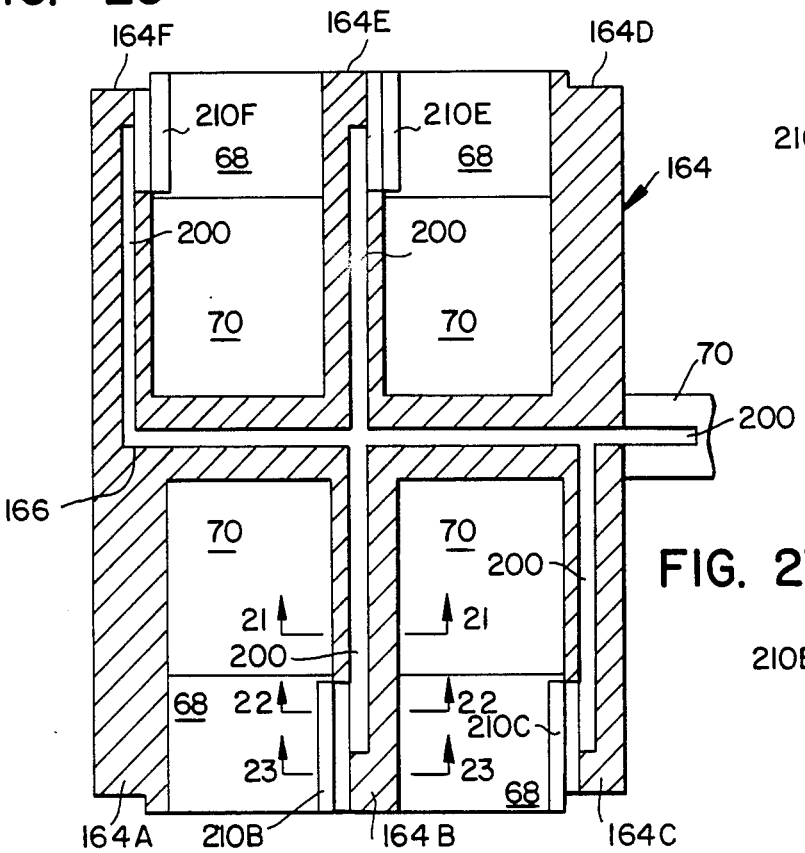
FIG. 20 is a cutaway view of the inner housing core shown in FIGS. 17–19, with the inner housing bottom plate installed, showing the configuration of the grounding bar.
Figure 23:
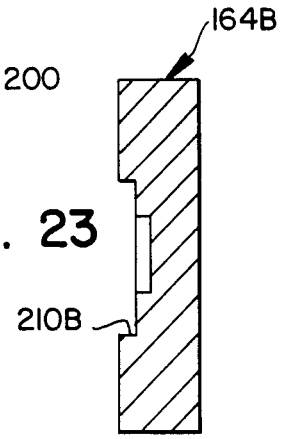
FIG. 23 is a third cutaway view of one of the legs of the inner housing core.

Moving now to FIGS. 17–20, the construction of the inner housing core 164, is shown to be radically different from the construction of the inner housing core 64. Whereas the inner housing core 64 is constructed entirely of electrically nonconductive material and is solid, the improved inner housing core 164, which itself is constructed of an electrically nonconductive material, contains therein an electrically conductive grounding bar 200, as best shown in FIGS. 19 and 20. The grounding bar is disposed midway between the top and the bottom of the inner housing core 164.

The inner housing core 164 may be viewed as having three walls 164A, 164B, and 164C extending from one side of a central spine 166, and three walls 164D, 164E, and 164F extending from the other side of the central spine 166. The three walls 164A, 164B, and 164C, define between them two slots into which a stage plug 130 may be inserted, and the three walls 164D, 164E, and 164F define between them two additional slots into which a stage plug 130 may be inserted. The grounding bar 200 extends through the central spine 166 and into the walls 164B, 164C, 164E, and 164F. In addition, the grounding bar extends out one side of the central spine 166, for connection to a grounding wire (not shown).

Referring now to FIG. 17, the installation of the hot contact plate 72 and the hot contact plate 74 on the top of an inner housing core 164 are illustrated. The inner housing top plate 66 would fit over the hot contact plate 72 and the hot contact plate 74 to hold them in position, as the hot contact plate 72 is illustrated in FIG. 19. Likewise, in FIG. 18, the installation of the neutral contact plate 70 on the bottom of the inner housing core 164 is shown. The inner housing bottom plate 68 would then fit over the neutral contact plate 70 to hold it in position, as shown in FIG. 19. The installation of the neutral contact plate 70, the hot contact plate 72, and the hot contact plate 74 on the inner housing core 164 is entirely conventional and the same as the installation onto the inner housing core 64 of FIG. 5.

The walls 164A and 164B define a first slot as shown in FIGS. 19 and 20, the walls 164B and 164C define a second slot as shown in FIGS. 19 and 20, the walls 164D and 164E define a third slot as shown in FIG. 20, and the walls 164E and 164F define a fourth slot as shown in FIG. 20. The side of the wall 164B facing the wall 164A, the side of the wall wall 164C facing the wall 164B, the side of the wall 164E facing the wall 164D, and the side of the wall 164F facing the wall 164E all have defined therein a recessed area 210B, 210C, 210E, or 210F, respectively, which recessed areas are for receiving the leg of the T of the ground terminal retaining plate 80, which as stated previously is narrower than the width of the housing 32. It will now be appreciated that the stage plug 130 will fit in only one way into each of the four slots defined between adjacent walls.

The inner housing core 164 may be molded in two halves, namely a first half including the walls 164A, 164B, and 164C and half of the central spine 166 therein, and a second half including the walls 164D, 164E, and 164F and the other half of the central spine therein. The two halves may then be assembled around the grounding bar 200. Alternately, the inner housing core 164 may be assembled from a plurality of flat wall segments molded to receive the grounding bar 200.

In either event, the assembled inner housing core 164 will receive up to four stage plugs 130, and both the stage plugs 130 and a plugging box made up of the inner housing core 164 are both polarized and grounded. It will be appreciated by those skilled in the art that the description herein is by way of example only, and that plugging boxes having one or more holes for one or more stage plugs may be manufactured according to the teachings of the present invention.

The grounding connection is made between the ground terminal contact 90 of the stage plug 130 and the grounding bar 200 mounted in the inner housing core 164. Due to the fact that the stage plug 130 can be inserted into a slot in the inner housing core 164 in only one orientation, the load carrying contact 36 may only contact one of the hot contact plates 72 and 74, and the load carrying contact 34 may only contact the neutral contact plate 70. This ensures the polarization of the stage plugs 130 and the plugging box.

Existing stage plugs may be modified to assume the new configuration, by replacing the top cover being with the thinner insulating layer and adding the ground terminal and the ground terminal retaining plate to the stage plug. Similarly, existing plugging boxes may be converted by replacing the existing inner housing core with the new inner housing core with the grounding bar. Completely new stage plugs and plugging boxes may also be made according to the teachings of the present invention. The construction of the present invention is simple and easy to implement on existing equipment at minimal cost.

The modification of existing stage plugs and plugging boxes and the construction of new stage plugs and plugging boxes according to the present invention achieves the important advantage of enabling the utilization of the AC powered state-of-the-art lighting equipment without necessitating the significant expenditures of obtaining all new electrical power transmission equipment which is unsuited for use in the theatrical, stage, and motion picture arts. In addition, the present invention achieves both polarization and grounding of the apparatus as well as all of the other aforesaid objectives and advantages without incurring any relative disadvantage, thereby making the present invention a highly desirable improvement in the electrical arts.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A polarized, grounded plug for use with AC, comprising:

a plug housing;

a first load carrying contact installed in said housing and exposed at one side of said housing at one end thereof;

a second load carrying contact installed in said housing and exposed at the other side of said housing at said one end thereof;

a thin insulating layer installed over the top of said housing, said thin insulating layer substantially covering the top of said housing;

A T-shaped ground terminal retaining plate having a slot located on the bottom side thereof and an aperture extending therethrough in the central portion of the leg of the T, the leg of said T being narrower than the width of said housing; and a ground terminal inserted into said slot on the bottom side of said ground terminal retaining plate, a portion of said ground terminal extending through said aperture in said ground terminal retaining plate to the top side thereof, said ground terminal retaining plate being secured over said thin insulating layer on the top side of said housing, thereby retaining said ground terminal between said ground terminal retaining plate and said thin insulating layer.

2. A plug as defined in claim 1, wherein said housing comprises:

means for supporting said first load carrying contact from said housing, the exposed portions of said first load carrying contact being supported by said housing for axial movement towards and away from said one side of said housing; and means for supporting said second load carrying contact from said housing, the exposed portions of said second load carrying contact being supported by said housing for axial movement towards and away from said other side of said housing.

3. A plug as defined in claim 2, additionally comprising:

first biasing means for biasing said first load carrying contact in an outward direction away from said one side of said housing; and second biasing means for biasing said second load carrying contact in an outward direction away from said other side of said housing.

4. A plug as defined in claim 3, wherein said first biasing means comprises:

a first spring, one end of said first spring being located in and supported by said plug housing, the other end of said first spring extending from said one side of said housing and contacting said first load carrying contact to urge it outwardly away from said first side of said housing, and said second biasing means comprises:

a second spring, one end of said second spring being located in and supported by said plug housing, the other end of said second spring extending from said other side of said housing and contacting said second load carrying contact to urge it outwardly away from said second side of said housing.

5. A plug as defined in claim 1, wherein said housing comprises:

an essentially rectangular portion having material removed from said one side and said other side at said one end of said housing to accommodate said first and second load carrying contacts, said essentially rectangular portion having at least one cavity disposed therein in which said first and second load carrying contacts are mounted.

6. A plug as defined in claim 1, wherein said housing comprises:

a split housing end piece configured like a capital I with a tab extending out of the center of one of the sides of the I, the first load carrying contact being mounted on the top of the I, the second load carrying contact being located on the bottom of the I; and a housing base piece having a notch located at one end thereof for receiving said tab extending out of the side of the I, said housing base piece having material remover intermediate the top and bottom surfaces of said one end of said housing base piece to allow said top and bottom surfaces of said one end of said housing base piece to fit over a portion of said first and second load carrying terminals.

7. A plug as defined in claim 1, wherein said aperture in said ground terminal retaining plate communicates with said slot to allow said ground terminal to extend from said slot through said aperture to the top surface of said ground terminal retaining plate.

8. A plug as defined in claim 7, wherein the portion of said ground terminal extending through said aperture to the top surface of said ground terminal retaining plate is a flat contact portion which extends over a portion of the top surface of said ground terminal retaining plate at an intermediate location on the leg of the T.

9. A plug as defined in claim 1, wherein said plug is arranged and configured to fit into a receptacle comprising:

an inner housing core including at least two walls defining therebetween a slot for receiving said plug, one of said walls including in the side facing the other wall a recessed area for receiving the narrowed width of the leg of the T of said ground terminal retaining plate, the side of said other wall facing said one wall being relatively flat, said plug being insertable into said slot in only one orientation;

a neutral contact plate mounted at the bottom of said walls for contacting one of said load carrying contacts;

a hot contact plate mounted at the top of said walls for contacting the other of said load carrying contacts; and a grounding bar having a portion thereof located in said recessed area in said one wall for contacting said portion of said ground terminal extending through said aperture in said ground terminal retaining plate to the top side thereof.

10. A plug as defined in claim 9, wherein a plurality of identical receptacles are manufactured in an integral unit with common walls, each of said receptacles having a grounding contact, a hot contact, and a neutral contact, each of said receptacles having a recess located therein to receive a plug in a single orientation only.

11. A plug as defined in claim 10, additionally comprising:

an additional hot contact plate, said additional hot contact plate for supplying power to at least one of said identical receptacles.

12. A plug as defined in claim 9, wherein said inner housing core is of molded construction to receive said hot contact plate, said neutral contact plate, and said grounding bar.

13. A plug as defined in claim 9, additionally comprising:

a top plate for retaining said hot contact plate in position at the top of said walls; and a bottom plate for retaining said neutral contact plate in position at the bottom of said walls.

14. A plug as defined in claim 9, wherein said inner housing core is manufactured of non-conductive material, additionally comprising:

a rigid outer housing for supporting said inner housing core.

15. An electrical plug for use in making high power temporary connections to a source of electrical power, comprising:

a first load carrying contact;

a second load carrying contact;

a housing on which said first and second load carrying contacts are mounted, said housing having means for supporting said first and second load carrying contacts, said housing supporting said first load carrying contact with a portion of said first load carrying contact being exposed on one side of said housing at one end thereof, said housing supporting said second load carrying contact with a portion of said second load carrying contact being exposed on the other side of said housing at said one end thereof;

first biasing means for biasing said first load carrying contact in an outward direction away from said one side of said housing;

second biasing means for biasing said second load carrying contact in an outward direction away from said other side of said housing;

an insulating layer mounted on the top side of said housing;

a ground terminal retaining plate for mounting on top of said insulating layer, said ground terminal retaining plate havig a T-shaped configuration with the leg of the T extending up to said one end of said housing at which said exposed portions of said load carrying contacts are located and the top of the T extending across the other end of said housing, the leg of the T being narrower than the width of said housing; and a ground terminal retained between said said ground terminal retaining plate and said thin insulating layer, a portion of said ground terminal extending above the surface of said ground terminal carrying plate.

16. A polarized, grounded plug electrical connector for use with AC, comprising:

a plug comprising:

a plug housing;

a pair of load carrying contacts installed in said housing and exposed at opposite sides of one end of said housing;

a thin insulating layer installed over the top of said housing, said thin insulating layer substantially covering the top of said housing;

a T-shaped ground terminal retaining plate having a slot located on the bottom side thereof and an aperture extending therethrough in the central portion of the leg of the T, the leg of said T being narrower than the width of said housing; and a ground terminal inserted into said slot on the bottom side of said ground terminal retaining plate, a portion of said ground terminal extending through said aperture in said ground terminal retaining plate to the top side thereof, said ground terminal retaining plate being secured over said thin insulating layer on the top side of said housing, thereby retaining said ground terminal between said ground terminal retaining plate and said thin insulating layer; and a receptacle comprising:

a receptacle housing;

an inner housing core including at least two walls defining therebetween a slot for receiving said plug, one of said walls including in the side facing the other wall a recessed area for receiving the leg of the T of said ground terminal retaining plate, the side of said other wall facing said one wall being relatively flat, said plug being insertable into said slot in only one orientation;

a neutral contact plate mounted at the bottom of said walls for contacting one of said load carrying contacts;

a hot contact plate mounted at the top of said walls for contacting the other of said load carrying contacts; and a grounding bar having a portion thereof located in said recessed area in said one wall for contacting said portion of said ground terminal extending through said aperture in said ground terminal retaining plate to the top side thereof.

17. A method of converting an unpolarized, ungrounded DC stage plug of the type having the two load carrying contacts exposed at opposite sides of one end of a housing to a polarized, grounded plug for use with AC, comprising:

removing the top cover from the housing of the stage plug;

replacing said top cover with a thin insulating layer substantially covering the top of said housing;

inserting a ground terminal into a slot located on the bottom side of a T-shaped ground terminal retaining plate, a portion of said ground terminal extending through an aperture in said ground terminal retaining plate to the top side thereof; and securing said ground terminal retaining plate over said thin insulating layer on the top side of said housing, thereby retaining said ground terminal between said ground terminal retaining plate and said thin insulating layer.

18. A method as defined in claim 17, further comprising:

mounting in a receptacle housing an inner housing core including at least two walls defining therebetween a slot for receiving a polarized, grounded stage plug, one of said walls including in the side facing the other wall a recessed area for receiving the leg of the T of said ground terminal retaining plate, the side of said other wall facing said one wall being relatively flat, said polarized, grounded stage plug being insertable into said slot in only one orientation;

mounting a neutral contact plate at the bottom of said walls for contacting one of said load carrying contacts;

mounting a hot contact plate at the top of said walls for contacting the other of said load carrying contacts; and installing a grounding bar in said recessed area in said one wall for contacting said portion of said ground terminal extending through said aperture in said ground terminal retaining plate to the top side thereof.

* * * * *